US011812784B2

(12) United States Patent
Liu

(10) Patent No.: US 11,812,784 B2
(45) Date of Patent: Nov. 14, 2023

(54) ELECTRONIC CIGARETTE

(71) Applicant: Shenzhen Eigate Technology Co., Ltd., Shenzhen (CN)

(72) Inventor: Tuanfang Liu, Shenzhen (CN)

(73) Assignee: ASPIRE NORTH AMERICA LLC

( * ) Notice: Subject to any disclaimer, the term of this patent is extended or adjusted under 35 U.S.C. 154(b) by 391 days.

(21) Appl. No.: 17/129,988

(22) Filed: Dec. 22, 2020

(65) Prior Publication Data

US 2021/0401037 A1 Dec. 30, 2021

(30) Foreign Application Priority Data

Jun. 29, 2020 (CN) ..... 202021230341.5
Sep. 17, 2020 (CN) ..... 202010979171.9

(51) Int. Cl.
*A24F 40/10* (2020.01)
*A24F 40/42* (2020.01)
*A24F 40/465* (2020.01)

(52) U.S. Cl.
CPC ..... *A24F 40/10* (2020.01); *A24F 40/42* (2020.01); *A24F 40/465* (2020.01)

(58) Field of Classification Search
CPC ..... A24F 40/10; A24F 40/465; A24F 40/42
See application file for complete search history.

(56) References Cited

U.S. PATENT DOCUMENTS

2019/0168246 A1* 6/2019 Tao ..... B05B 11/3015

* cited by examiner

*Primary Examiner* — Michael J Felton
*Assistant Examiner* — Daniel Edward Vakili
(74) *Attorney, Agent, or Firm* — MATTHIAS SCHOLL P.C.; Matthias Scholl

(57) ABSTRACT

An electronic cigarette includes a squeezing module. The squeezing module includes a first seal ring, a movable part, a spring, and a fixed base. The movable part is disposed in the fixed base and the outer wall of the movable part is slidable along the inner wall of the fixed base. The first seal ring is disposed between the outer wall of the movable part and the inner wall of the fixed base. The spring is disposed in the fixed base and below the movable part to reset the movable part when a pressure force on the movable part is withdrawn.

11 Claims, 6 Drawing Sheets

ELECTRONIC CIGARETTE

CROSS-REFERENCE TO RELATED APPLICATIONS

Pursuant to 35 U.S.C. § 119 and the Paris Convention Treaty, this application claims foreign priority to Chinese Patent Application No. 202021230341.5 filed on Jun. 29, 2020, and to Chinese Patent Application No. 202010979171.9 filed on Sep. 17, 2020. The contents of all of the aforementioned applications, including any intervening amendments thereto, are incorporated herein by reference. Inquiries from the public to applicants or assignees concerning this document or the related applications should be directed to: Matthias Scholl P. C., Attn.: Dr. Matthias Scholl Esq., 245 First Street, 18th Floor, Cambridge, Mass. 02142.

BACKGROUND

The disclosure relates to an electronic cigarette.

Conventionally, the heating wire of an electronic cigarette is directly immersed in the e-liquid. After a period of time, the quality of the e-liquid may be adversely affected by the heating wire.

SUMMARY

The disclosure provides an electronic cigarette, comprising a squeezing module; the squeezing module comprises a first seal ring, a movable part, a spring, and a fixed base; the movable part is disposed in the fixed base and an outer wall of the movable part is slidable along an inner wall of the fixed base; the first seal ring is disposed between the outer wall of the movable part and the inner wall of the fixed base; the spring is disposed in the fixed base and below the movable part to reset the movable part when a pressure force on the movable part is withdrawn.

In a class of this embodiment, the squeezing module further comprises a sleeve, a linkage part, and a stopper; an inner wall of the movable part is slidable along an outer wall of the sleeve; the linkage part is disposed in the stopper; the stopper is disposed on a bottom end of the movable part; a section of the stopper is a step structure; when the movable part resets under the resilience force of the spring, the stopper pushes the linkage part to move upwards.

In a class of this embodiment, the squeezing module further comprises a third seal ring; the third seal ring is attached to an upper surface and an inner surface of the linkage part; when the movable part is pressed down, the third seal ring, the movable part, and the linkage part are attached to each other to prevent air leakage; when the movable part is reset, the movable part is separated from the third seal ring to form a gap for air circulation.

In a class of this embodiment, the sleeve comprises an air passage; when the movable part is pressed down, air enters the air passage.

In a class of this embodiment, a built-in spring and a steel ball are disposed in the air passage; in the presence of air pressure, the steel ball moves upwards to open the air passage; when the air pressure is released, under the action of the built-in spring, the steel ball moves downward to close the air passage.

In a class of this embodiment, the squeezing module further comprises a pinhead and a contact pin; the pinhead is disposed on a top end of the contact pin and one end of the pinhead extends into an e-liquid tank; the contact pin is fixed on a top end of the sleeve; the contact pin comprises an air duct; the air passes through the air passage, the air duct, and an inner air passage of the pinhead to enter the e-liquid tank.

In a class of this embodiment, the squeezing module further comprises a guide tube and a dropper; one end of the guide tube is transversally disposed in the contact pin; the dropper is fixedly disposed around the other end of the guide tube; in the presence of air extrusion, e-liquid in the e-liquid tank flows into the contact pin via an inlet of the contact pin, through the guide tube, and flows out from the dropper.

In a class of this embodiment, the squeezing module further comprises a tank cover; a bottom end of the tank cover is disposed on the movable part; press the tank cover, the movable part is slidable in the fixed base.

In a class of this embodiment, the squeezing module further comprises a second seal ring disposed between the outer wall of the movable part and an inner wall of the tank cover.

In a class of this embodiment, the electronic cigarette further comprises a heating module; the heating module comprises a heater, a ceramic core, and a first base; the heater is fixed in the ceramic core and the ceramic core is fixed in the first base.

In a class of this embodiment, the heater is a cylinder comprising a concave inner surface and a metal wire in the shape of a spiral disc.

In a class of this embodiment, the atomization assembly comprises a second base; the squeezing module and the heating module are side by side disposed on the second base; the dropper of the squeezing module transversally extends into one side of the heating module and is disposed above the heater; the e-liquid drips into the heater for atomization.

DETAILED DESCRIPTION

To further illustrate, embodiments detailing an electronic cigarette are described below. It should be noted that the following embodiments are intended to describe and not to limit the disclosure.

Figure 1:
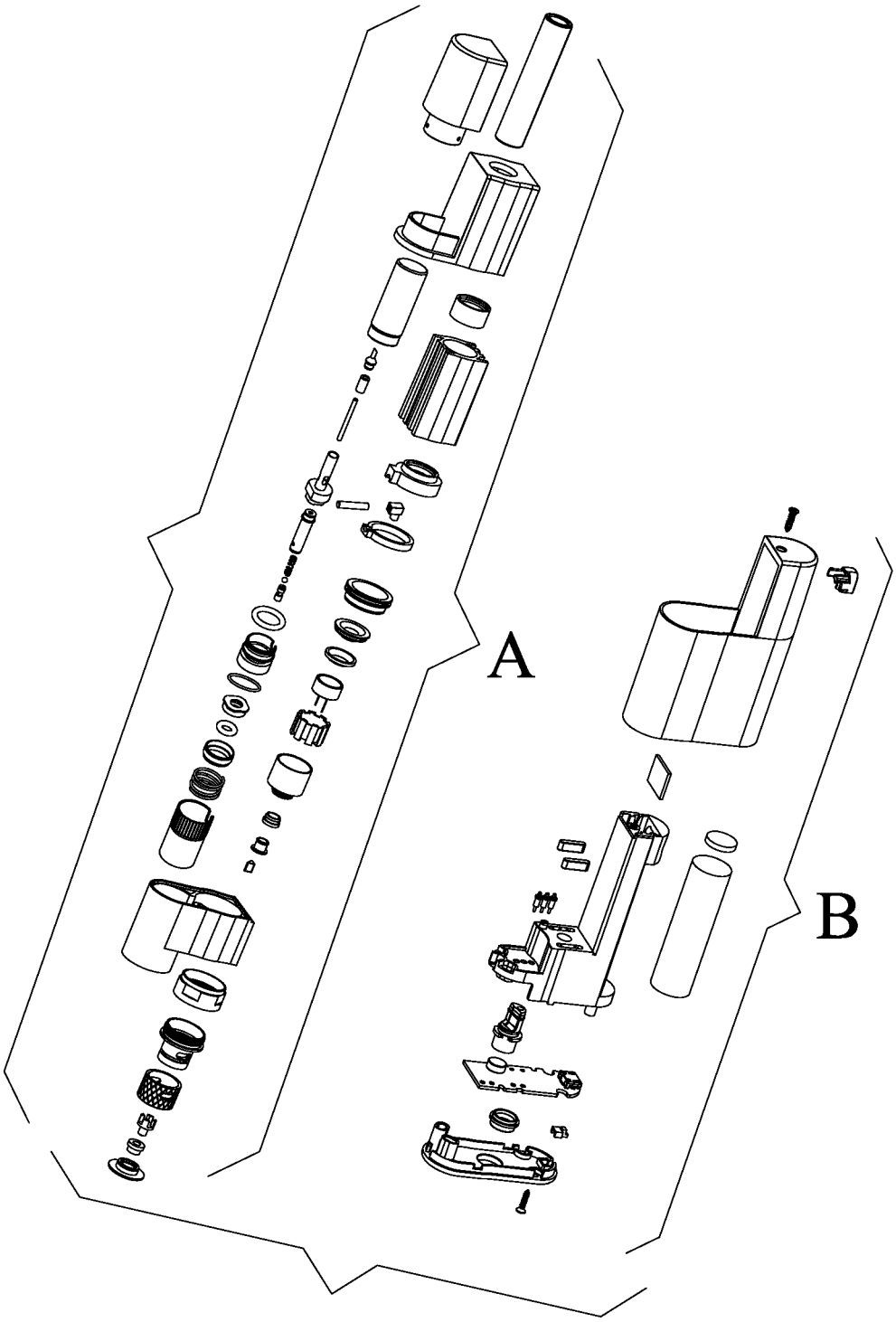
FIG. 1 is an exploded view of an electronic cigarette in accordance with one embodiment of the disclosure.
Figure 2:
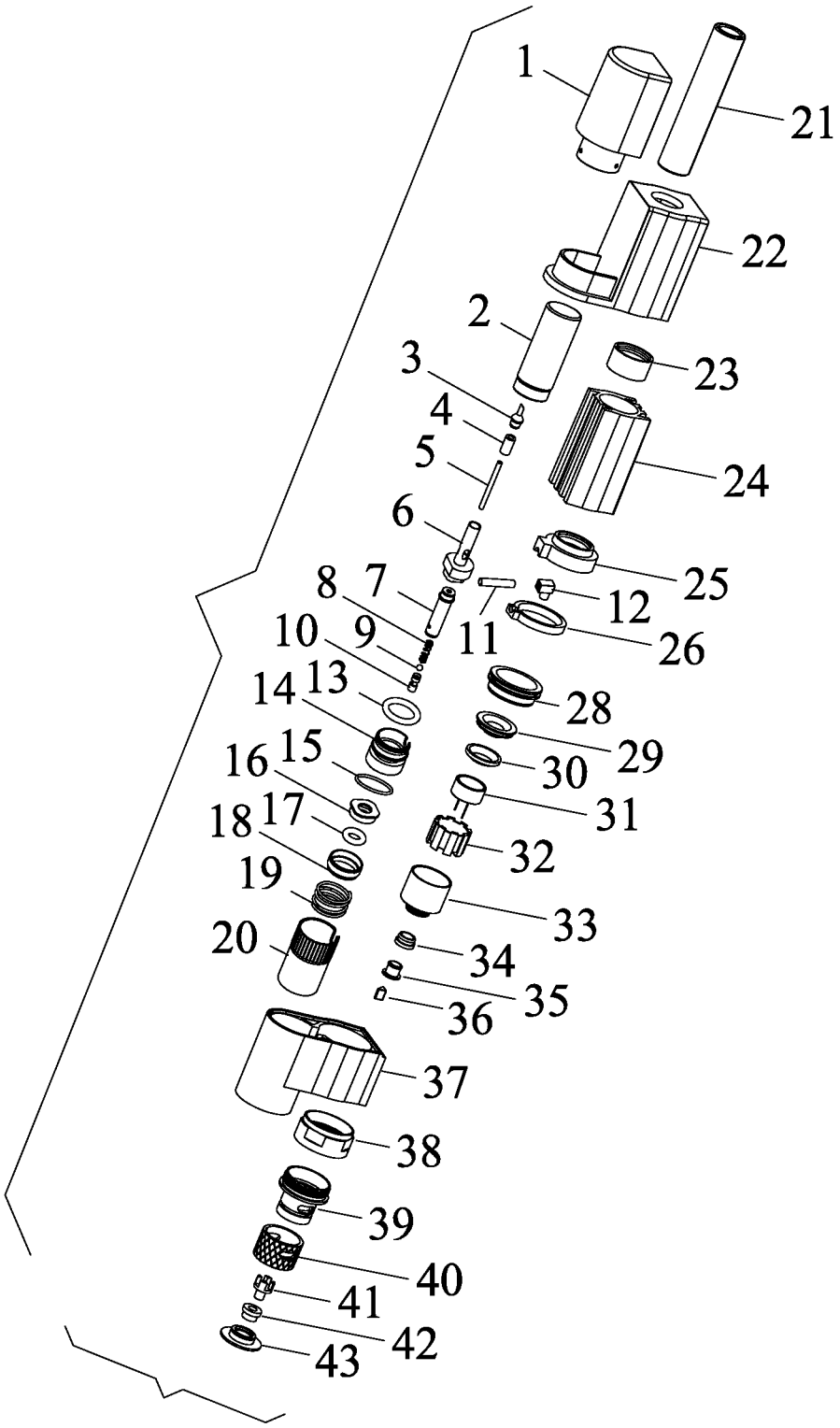
FIG. 2 is an exploded view of an atomization assembly of an electronic cigarette in accordance with one embodiment of the disclosure.
Figure 3:
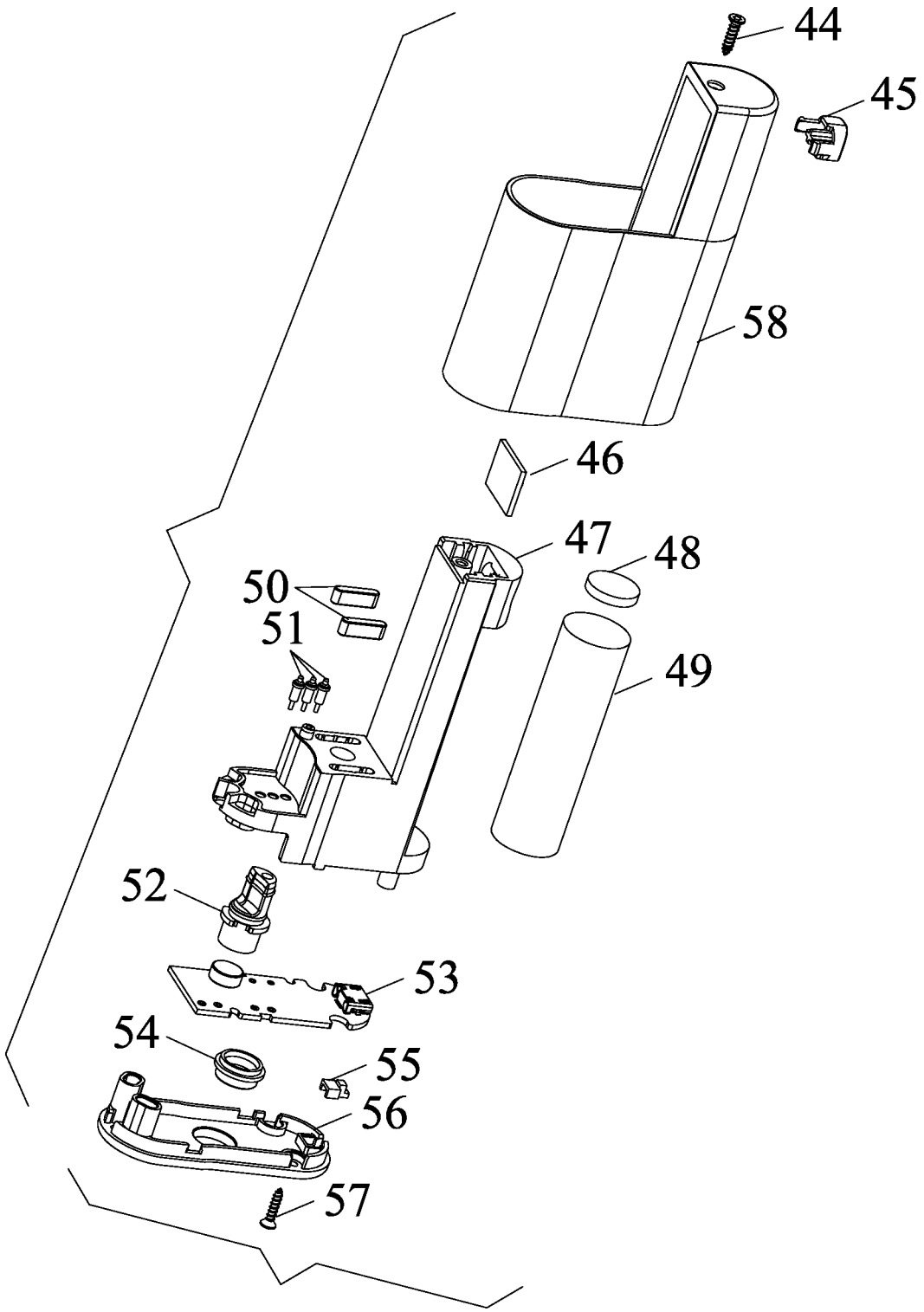
FIG. 3 is an exploded view of a battery assembly of an electronic cigarette in accordance with one embodiment of the disclosure.
Figure 4:
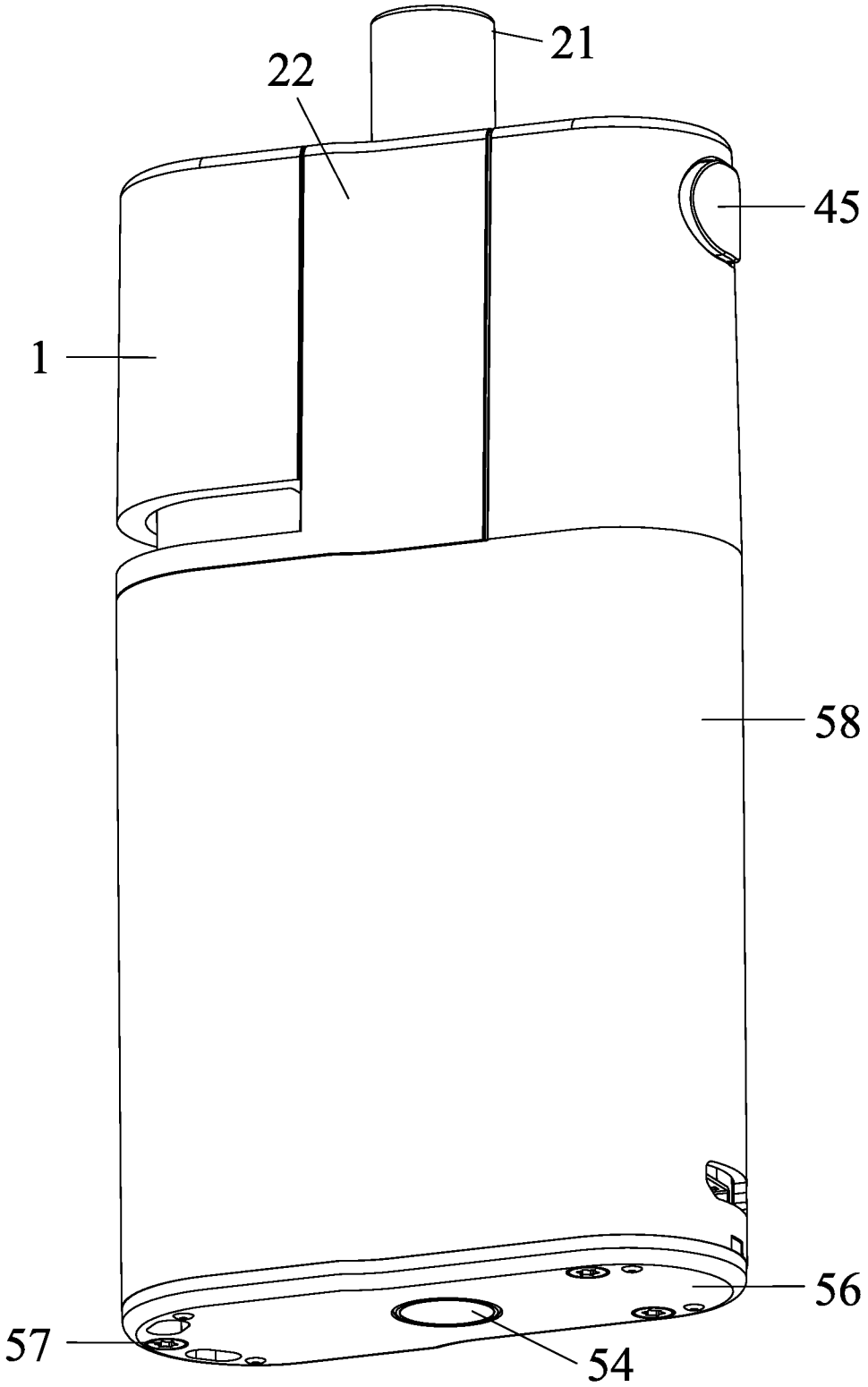
FIG. 4 is a schematic diagram of an electronic cigarette in accordance with one embodiment of the disclosure.
Figure 5:
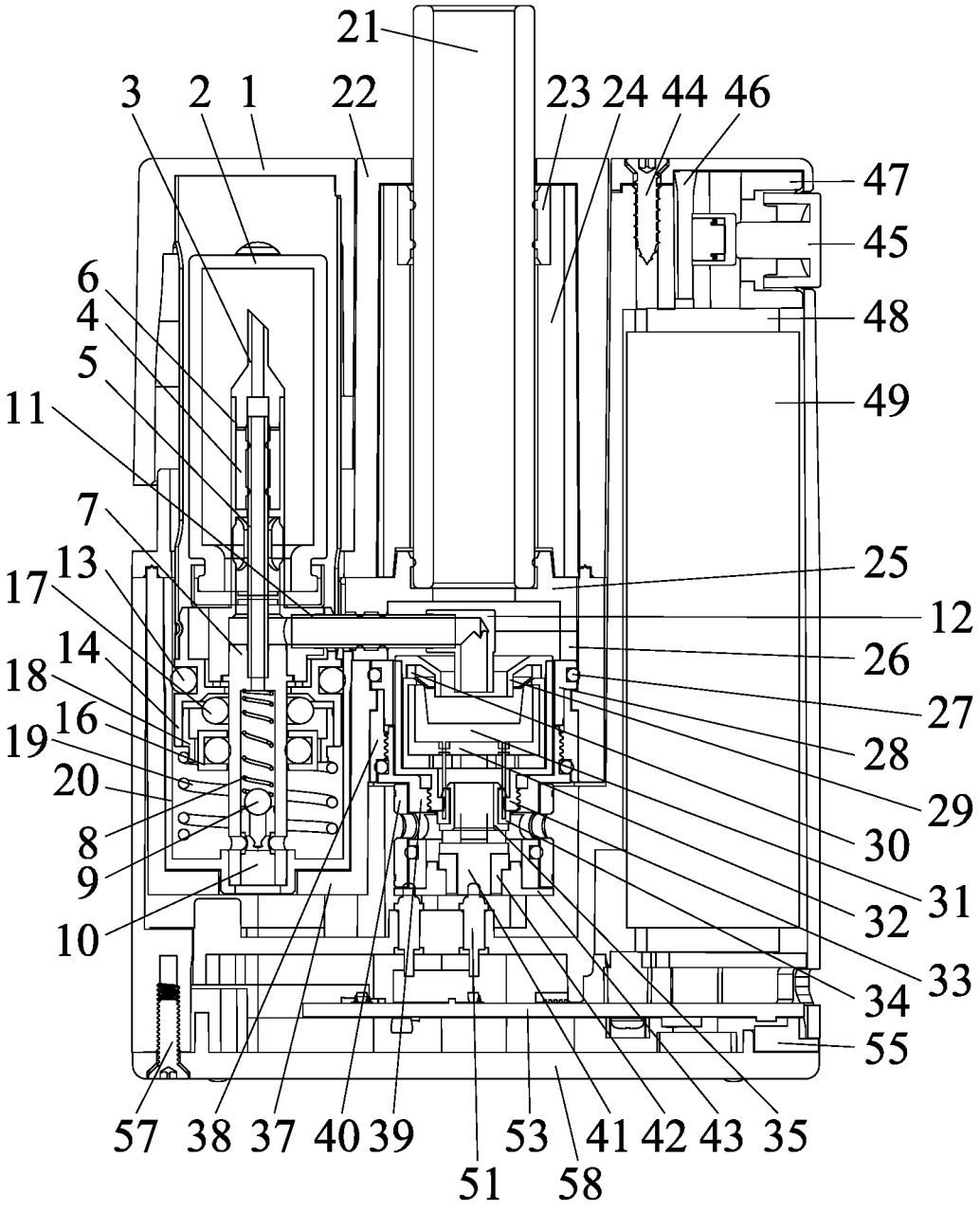
FIG. 5 is a sectional view of an electronic cigarette in accordance with one embodiment of the disclosure.
Figure 6:
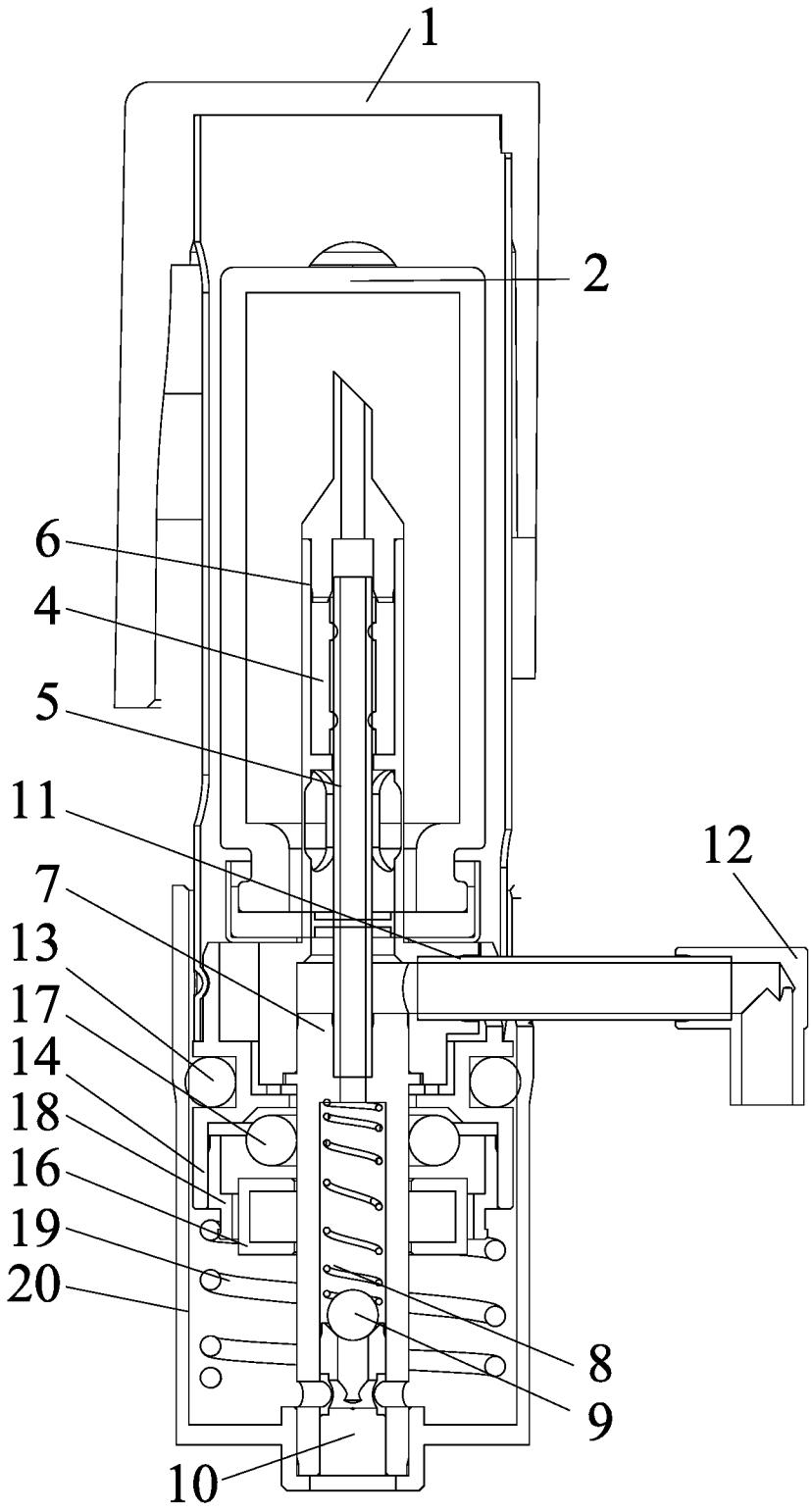
FIG. 6 is an enlarged view of an electronic cigarette in accordance with one embodiment of the disclosure.

As shown in FIGS. 1-6, the disclosure provides an electronic cigarette comprising an atomization assembly A and a battery assembly B connected to the atomization assembly. The atomization assembly A comprises a tank cover 1, an e-liquid tank 2, a pinhead 3, a plug 4, an air duct 5, a contact pin 6, a sleeve 7, a built-in spring 8, a steel ball 9, an air intake pin 10, a guide tube 11, a dropper 12, a first seal ring 13, a movable part 14, a second seal ring 15, a linkage part 16, a third seal ring 17, a stopper 18, a spring 19, a fixed base 20, a mouthpiece 21, an outer cover 22, a silicone sleeve 23, a fixed part 24, an upper silicone fixer 25, a lower silicone fixer 26, a fourth seal ring 27, a pression part 28, a cover 29, a leakproof silicone piece 30, a heater 31, a ceramic core 32, a first base 33, an insulation ring 34, a joint 35, a first magnet 36, a second base 37, a threaded base 38, a connection piece 39, an airflow regulation ring 40, an inner joint 41, a rubber ring 42, a bottom base 43. The pinhead 3 is disposed on the top end of the contact pin 6 and one end of the pinhead extends into the e-liquid tank 2. The plug 4 is disposed on the contact pin 6 to prevent the e-liquid from flowing to the top end of the contact pin 6. The air duct 5 is disposed through the plug 4 and on the bottom end of the pinhead 3 for air circulation. The contact pin 6 is fixed on the top end of the sleeve 7. The built-in spring 8, the steel ball 9, and the air intake pin 10 are sequentially disposed in the air passage of the sleeve 7. One end of the guide tube 11 is transversally disposed in the contact pin 6. The dropper 12 is fixedly disposed around the other end of the guide tube 11. The spring 19 is fixed in the fixed base 20. The third seal ring 17 is attached to the upper surface and the inner surface of the linkage part 16. The linkage part 16 is disposed in the stopper 18. The stopper 18 is disposed in the bottom end of the movable part 14. The sleeve 7 is disposed through the movable part 14, the linkage part 16, and the stopper 18. The second seal ring 15 is disposed between the outer wall of the movable part 14 and the inner wall of the tank cover 1. The movable part 14 is disposed in the fixed base 20. The first seal ring 13 is disposed between the outer wall of the movable part 14 and the inner wall of the fixed base 20. The stopper 18 is disposed on the top of the spring 19. The fixed base 20 is fixed in a first groove of one side of the second base 37. The fourth seal ring 27 is disposed on the pression part 28. The heater 31 is fixed in the ceramic core 32 and the ceramic core 32 is fixed in the first base 33. The leakproof silicone piece 30 is disposed on the bottom end of the cover 29 and the cover 29 is disposed on the top opening of the first base 33. The pression part 28 is disposed on the top opening of the first base 33. The insulation ring 34 is disposed around the bottom end of the first base 33 to insulate the positive and negative terminals of the heater 31. The joint 35 is disposed in the insulation ring 34 to fix the heater 31 and contacts the positive and negative terminals of the battery. The first magnet 36 is disposed on the bottom end of the second base 37. The threaded base 38 is fixed in a second groove of the other side of the second base 37. The airflow regulation ring 40 is disposed on the connection piece 39. The connection piece 39 is disposed on the threaded base 38. The inner joint 41 is disposed in the rubber ring 42 and fixed in the bottom base 43. The base 43 is disposed through the airflow regulation ring 40 and disposed on the connection piece 39. The airflow regulation ring 40 is fixed on the connection piece 39. The first base 33 is fixed in the second groove of the second base 37 and is in threaded connection to the connection piece 39. The silicone sleeve 23 and the upper silicone fixer 25 are fixed in an upper channel and a lower channel of the fixed part 24, respectively. The lower silicone fixer 25 is connected to the upper silicone fixer 26. The fixed part 24 is fixed in a passage on one side of the outer cover 22. The outer cover 22 is disposed on the second base 37. One end of the guide tube 11 transversally disposed through a space between the upper silicone fixer 25 and the lower silicone fixer 26. The dropper 12 is disposed on the heater 31 to squeeze the e-liquid into the heater for atomization. The e-liquid tank 2 is disposed on the contact pin 6. The tank cover 1 is disposed on the e-liquid tank 2 and the bottom end of the tank cover 1 contacts the movable part 14. The mouthpiece 21 disposed through the passage on one side of the outer cover 22, the silicone sleeve 23, the fixed part 24, and is fixed on the upper silicone fixer 25.

The battery assembly B comprises a first screw 44, a power button 45, a switch plate 46, a support 47, an ethylene vinyl acetate gasket 48, a battery 49, a second magnet 50, an electrode 51, a silicone sleeve 52, a control panel 53, a control button 54, a light guide 55, a bottom cover 56, a second screw 57, and a housing 58. The switch plate 46 is fixed in the top end of the support 47. The lead of the switch plate 46 is soldered on the control circuit of the control panel 53. The power button 45 is disposed on the switch plate 46. The input terminal of the control panel 53 is soldered on the positive and negative terminals of the battery 49. The ethylene vinyl acetate gasket 48 is attached to the positive and negative terminals of the battery 49 for electric insulation. The battery 49 is fixed in the support 47. The electrode 51 is fixed on the support 47. The second magnet 50 is fixed in the support 47. The output terminal of the control panel 53 is soldered on the electrode 51 and contacts the atomization assembly. The light guide 55 is disposed on the bottom cover 56. The silicone sleeve 52 is disposed on a pneumatic switch of the control panel 53. The control button 54 is disposed on the control panel 53. The control panel 53 is fixed on the bottom end of the support 47. The support 47 is fixed in the housing 58 through the first screw 44. The bottom cover 56 is fixed on the bottom end of the housing 58 via the second screw 57. The atomization assembly is connected to the battery assembly through the magnetic force of the first magnet 36 and the second magnet 50.

The following advantages are associated with the electronic cigarette of the disclosure:

1. The electronic cigarette comprises a squeezing module comprising a tank cover and an e-liquid tank. Press the tank cover, and the air is pushed into the e-liquid tank. The air drives the e-liquid in the e-liquid tank to flow into the heater of the electronic cigarette for atomization.

2. The preheater comprises an e-liquid tank with a scale and sealed by silica gel and aluminum foil. When in use, the contact pin is inserted into the e-liquid tank and the e-liquid flows out. It is easy to operate.

3. The squeezing module comprises an air passage and an e-liquid passage which are independent from each other for air circulation and e-liquid transmission, improving the atomization efficiency of e-liquid.

4. The heater is a cylinder comprising a concave inner surface and a metal wire in the shape of a spiral disc. This increases the heating area of the e-liquid.

It will be obvious to those skilled in the art that changes and modifications may be made, and therefore, the aim in the appended claims is to cover all such changes and modifications.

What is claimed is:

1. An electronic cigarette comprising a squeezing module, the squeezing module comprising a first seal ring, a movable part, a spring, a fixed base, a sleeve, a linkage part, and a stopper; wherein:

the movable part is disposed in the fixed base, and an outer wall of the movable part is slidable along an inner wall of the fixed base;

the first seal ring is disposed between the outer wall of the movable part and the inner wall of the fixed base;

the spring is disposed in the fixed base and below the movable part to reset the movable part when a pressure force on the movable part is withdrawn;

an inner wall of the movable part is slidable along an outer wall of the sleeve;

the linkage part is disposed in the stopper;

the stopper is disposed on a bottom end of the movable part;

a section of the stopper is a step structure; and when the movable part resets under the resilience force of the spring, the stopper pushes the linkage part to move upwards.

2. The electronic cigarette of claim 1, wherein the squeezing module further comprises a third seal ring; the third seal ring is in contact with an upper surface and an inner surface of the linkage part; when the movable part is pressed down, the third seal ring, the movable part, and the linkage part are pressed together to form a seal to prevent air leakage; when the movable part is reset, the movable part is separated from the third seal ring to form a gap for air circulation.

3. The electronic cigarette of claim 1, wherein the sleeve comprises an air passage; when the movable part is pressed down, air enters the air passage.

4. The electronic cigarette of claim 3, wherein a built-in spring and a steel ball are disposed in the air passage; in the presence of air pressure, the steel ball moves upwards to open the air passage; when the air pressure is released, under the action of the built-in spring, the steel ball moves downward to close the air passage.

5. The electronic cigarette of claim 4, wherein the squeezing module further comprises a pinhead and a contact pin; the pinhead is disposed on a top end of the contact pin and one end of the pinhead extends into an e-liquid tank; the contact pin is fixed on a top end of the sleeve; the contact pin comprises an air duct; the air passes through the air passage, the air duct, and an inner air passage of the pinhead to enter the e-liquid tank.

6. The electronic cigarette of claim 5, wherein the squeezing module further comprises a guide tube and a dropper; one end of the guide tube is transversally disposed in the contact pin; the dropper is fixedly disposed around the other end of the guide tube; in the presence of air flow, e-liquid in the e-liquid tank flows into the contact pin via an inlet of the contact pin, through the guide tube, and flows out from the dropper.

7. The electronic cigarette of claim 6, wherein the squeezing module further comprises a tank cover; a bottom end of the tank cover is disposed on the movable part; whereby pressing the tank, cover causes the movable part to slide in the fixed base.

8. The electronic cigarette of claim 7, wherein the squeezing module further comprises a second seal ring disposed between the outer wall of the movable part and an inner wall of the tank cover.

9. The electronic cigarette of claim 8, further comprising a heating module, wherein the heating module comprises a heater, a ceramic core, and a first base; the heater is fixed in the ceramic core and the ceramic core is fixed in the first base.

10. The electronic cigarette of claim 9, wherein the heater is a cylinder comprising a concave inner surface and a metal wire in the shape of a spiral disc.

11. The electronic cigarette of claim 10, wherein the electronic cigarette further comprises a second base; the squeezing module and the heating module are side by side disposed on the second base; the dropper of the squeezing module transversally extends into one side of the heating module and is disposed above the heater; the e-liquid drips into the heater for atomization.

* * * * *